US006520087B2

(12) United States Patent
Heinzl et al.

(10) Patent No.: US 6,520,087 B2
(45) **Date of Patent: *Feb. 18, 2003**

(54) METHOD AND APPARATUS FOR PRINTING A CARRIER MATERIAL UPON EMPLOYMENT OF A STRUCTURE ICE LAYER

(75) Inventors: Joachim Heinzl, Munich (DE); Robert Link, Munich (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/915,673

(22) Filed: Jul. 26, 2001

(65) Prior Publication Data

US 2002/0170452 A1 Nov. 21, 2002

Related U.S. Application Data

(63) Continuation of application No. 09/355,432, filed on Sep. 21, 1999, now Pat. No. 6,295,928.

(30) Foreign Application Priority Data

Jan. 27, 1997 (DE) ..... 197 02 861

(51) Int. Cl.[7] ..... B41C 1/10

(52) U.S. Cl. ..... 101/465; 101/450.1; 101/478; 101/487

(58) Field of Search ..... 101/450.1, 451, 101/452, 463.1, 465–467, 478, 487, 488; 347/88, 89

(56) References Cited

U.S. PATENT DOCUMENTS

| | | | | | |
|---|---|---|---|---|---|
| 3,741,118 | A | | 6/1973 | Carley | 101/451 |
| 4,003,312 | A | | 1/1977 | Gunther | 101/466 |
| 4,833,486 | A | * | 5/1989 | Zerillo | 101/466 |
| 5,067,404 | A | | 11/1991 | Frunder et al. | 101/488 |
| 5,072,671 | A | | 12/1991 | Schneider et al. | 101/467 |
| 5,375,518 | A | | 12/1994 | Kurz | 101/487 |
| 5,409,530 | A | | 4/1995 | Kanbayashi et al. | 347/99 |
| 5,440,987 | A | | 8/1995 | Williams et al. | 101/467 |
| 5,694,848 | A | | 12/1997 | Palmatier | 101/487 |
| 5,738,013 | A | * | 4/1998 | Kellett | 101/463.1 |
| 5,992,323 | A | * | 11/1999 | Eltgen | 101/463.1 |
| 6,058,841 | A | * | 5/2000 | Ray et al. | 101/478 |
| 6,125,755 | A | | 10/2000 | Link et al. | 101/478 |
| 6,295,928 | B1 | * | 10/2001 | Heinzl et al. | 101/465 |

FOREIGN PATENT DOCUMENTS

| | | |
|---|---|---|
| DE | 460 035 | 4/1928 |
| DE | 24 48 325 | 4/1976 |
| EP | 0 099 731 | 2/1984 |
| GB | 1 208 731 | 10/1970 |

* cited by examiner

*Primary Examiner*—Stephen R. Funk
(74) *Attorney, Agent, or Firm*—Schiff Hardin & Waite

(57) ABSTRACT

A printer includes a printer carrier having a surface for receiving ink for transfer printing onto a carrier material, such as paper. Areas of the surface print carrier are ink attracting and others are made ink repelling. The ink repelling areas are formed by providing the surface with a layer of a substance in a solid phase, such as water in the form of ice. The ice layer repels the ink as it is applied so that the ink is only held on the surface of the print carrier at the areas that are ice free. The ice layer is formed by cooling the surface using a cooling mechanism to form a coating of frost due to condensation. A surface tension reducer for water is coated on the surface prior to cooling the surface. A laser or other radiation emitter structures the ice layer to form the print image.

26 Claims, 1 Drawing Sheet

METHOD AND APPARATUS FOR PRINTING A CARRIER MATERIAL UPON EMPLOYMENT OF A STRUCTURE ICE LAYER

CROSS-REFERENCE TO RELATED APPLICATION

This is a Continuation Application of Ser. No. 09/355,432, filed Sep. 21, 1999, now U.S. Pat. No. 6,295,928.

BACKGROUND OF THE INVENTION

1. Field of the Invention

The present invention is directed to a method for producing a print image on a carrier material, whereby ink-attracting and ink-repelling areas are produced on a surface of a print medium according to the structure of the print image to be printed, whereby the ink-repellant areas are provided with a layer of an ink-repellant medium, ink is applied onto the surface, this adhering to the ink-attracting areas and not being picked up by the ink-repellant areas, and whereby the ink distributed on the surface is printed onto the carrier material.

The invention is also directed to an apparatus for producing a print image on a carrier material.

2. Description of the Related Art

Given a known offset printing process which works without water, the areas not to be printed are fat-repellant, they do not accept any ink. The areas to be printed, by contrast, are fat-attracting and can accept fat-containing ink. The ink-attracting and ink-repellant areas are distributed on a printing plate such that they reproduce the print image to be printed. The printing plate can be employed for a plurality of transfer printing events. A new printing plate with ink-attracting and ink-repellant areas must be produced for each print image.

Given the known direct imaging method of Heidelberger Druckmaschinen, a print master is produced in the printing system on a silicone-coated film by partially burning the silicone layer off. The silicone-free locations form the color-attracting areas and can pick color up during the printing process.

In another offset process working with water, hydrophobic and hydrophilic areas corresponding to the structure of the print image to be printed are produced on the print medium. Before applying ink to the print carrier, a thin moisture film is first applied onto the print carrier by employing application rollers or, respectively, sprayer devices, this wetting the hydrophilic area of the print carrier. With the assistance of an inking roller, ink is subsequently applied onto the surface of the print carrier; this, however, moistens only the areas not covered with the moisture film. After the inking of the print carrier, the ink print image is finally transferred onto the carrier material.

A method developed by Oce Printing Systems GmbH is also known wherein hydrophobic and hydrophilic areas are formed on the surface of the print carrier. The hydrophilic areas are moistened, so that no ink adheres to them. The surface of the print carrier is charged with water steam for moistening. The charging with water steam can also ensue such that hydrophilic areas arise corresponding to the structures of the print image to be printed. The ink is only picked up by areas that have not been provided with a moisture film. The aforementioned methods have the problem that the ink-water equilibrium must be very narrowly toleranced in order to achieve a high printing quality.

British patent document GB-A-1208731 discloses a method or, respectively, an apparatus for producing a print image on a carrier material. A substance in its solid phase is applied on a surface of a carrier material. This substance is heat sensitive and can be structured according to predetermined picture elements under the influence of heat, whereby this solid substance is removed. The uncovered surface of the print carrier can be brought into a hydrophilic condition. When inking with ink particles containing water, these adhere to the hydrophilic areas, whereas the hydrophobic areas of the substance in its solid phase repel these ink particles.

U.S. Pat. No. 3,741,118 discloses and method and an apparatus for printing an image, whereby a technique is utilized that approximately corresponds to a standard lithography technique. Upon application of electronic scanning technology, ink is selectively applied on a plate or an existing layer is selectively removed. The ink on the plate is then transferred onto paper. Subsequently, the plate is cleaned and can be prepared anew for the acceptance of ink.

SUMMARY OF THE INVENTION

An object of the present invention is to provide a method and an apparatus for producing a print image on a carrier material that produces print images with high resolution and is largely compatible with previous printing processes or, respectively, printing devices.

This object is achieved by a method for producing a print image on a carrier material, including the steps of: producing ink-attracting and ink-repellant areas on a surface of a print carrier in conformity with a structure of the print image to be printed, providing the ink-repellant areas with a layer of an ink-repellant medium, supplying ink onto the surface, the ink adhering to the ink-attracting areas and being not picked up by the ink-repellant areas, printing the ink distributed on the surface onto the carrier material, using a substance in its solid phase as an ink-repellant medium in the ink-repellant areas, cooling the surface of the print carrier to produce the solid phase of the substance on the surface of the print carrier.

The employment of a solid substance as an ink-repellant medium has the advantage that a sharp boundary arises between ink-attracting and ink-repellant areas, as a result whereof the resolution of the print image is enhanced. Given employment of a substance in its solid phase, further, this does not run dry and no water streaks arise as is possible given traditional printing processes. The procedure known from offset printing for inking the print carrier and for transfer printing onto a carrier material can be retained.

An ice layer is preferably employed as an ink-repellant medium, this being deposited by condensation of water vapor in the environment of the print medium by spraying a thin water film or by application of a water film with rollers and subsequent formation of ice on the surface thereof. This ice layer has a defined form and a defined volume and offers relatively great resistance to a shape or volume change under the influence of external forces since the water molecules in the solid aggregate state are firmly bonded to one another at specific locations by electromagnetic interactions. The ink-repellant areas can thus be produced with a fine structure that leads to a print image having a high resolution. The ice layer becomes extremely uniform and thin as a result of adding an agent for reducing the surface tension of the water, preferably tensides or alcohol. The additives are located directly in the water and/or are applied on the print carrier by spraying or, respectively, application with a roller. Solid parting agents such as waxes, fats, resins or fatty acid amides can be employed as a further ink-repellant medium, these being applied onto the print carrier in the liquid condition by spraying or application with one or more rollers. The medium will convert into its solid phase on the printing plate which is cooled to below the solidification temperature of the respective substance.

In a preferred exemplary embodiment of the invention, the print-active surface of the print carrier is initially completely provided with an ice layer or with a parting agent layer composed of wax, fat, resin or fatty acid amides. In a following structuring process, ink-attracting areas that are free of said solid layer, for example of the ice layer or of the parting agent layer, are produced. Ink-attracting areas corresponding to the structure of the print image to be printed can be produced in this way.

In this exemplary embodiment, the surface of the print carrier need not be pre-treated according to the structure of the print image to be printed, for example by etching. On the contrary, the print-active surface is uniform and smooth in the initial condition. The structuring process merely comprises the production of areas which are free of solid bodies or, respectively, free of ice in conformity with the structure of the print image to be printed. In accord therewith, a plurality of print images can be produced on the surface of the print carrier, whereby the initial condition of the surface of the print carrier is to be produced for each print image. In this way, different print images can be produced without replacing the print carrier and can be inked and transfer-printed once or repeatedly. When a new print image is to be applied on the print carrier, then the print carrier is to be cleaned of the areas provided with the solid state layer or, respectively, ice layer as well as of ink residues, the surface is to be provided again with a solid state layer or, respectively, ice layer, and a new structuring process ensues.

The gradient energy of a laser beam or of an LED can be employed for selectively producing areas which are free of solid bodies or, respectively, free of ice on the surface of the print carrier. Another possibility is comprised in selectively producing the areas free of solid bodies by employing heating elements.

According to a further aspect of the invention, a means for implementing the disclosed method is recited.

BRIEF DESCRIPTION OF THE DRAWINGS

Exemplary embodiments of the invention are explained below with reference to the drawings.

DETAILED DESCRIPTION OF THE PREFERRED EMBODIMENTS

Figure 1:
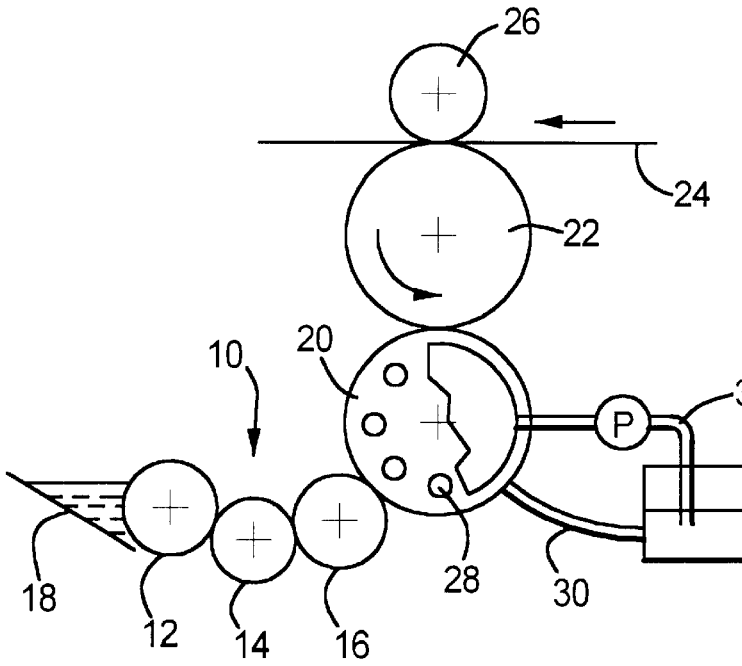
FIG. 1 is a side view showing the schematic structure of an apparatus for offset printing, whereby an ice layer is produced on the plate cylinder.

FIG. 1 schematically shows the structure of an apparatus for offset printing. It contains an inking unit 10 with three rollers 12, 14 and 16 with which ink from an ink reservoir 18 is transferred onto the surface of a print carrier fashioned as a plate cylinder 20. The inked surface of the plate cylinder 20 transfers ink onto a rubber coated cylinder 22 from this, the ink proceeds onto a paper web 24 that is pressed against the rubber blanket cylinder 22 by a counter-pressure cylinder 26. The arrows entered in FIG. 1 indicate the respective conveying direction.

The plate cylinder 20 contains pipes for a coolant system 28 through which coolant is pumped. A cooling system 34 that offers coolant having the required temperature is connected to the coolant system 28 via hoses 30 and 32. A pump P is inserted into the delivery line 32. During operation, an ice layer condenses onto the hydrophilic areas of the surface of the plate cylinder 20. This ice layer acts in an ink-repellant fashion, so that ink consequently does not precipitate on the ice layer. Ink is transferred from the drum 16 to the rubber blanket cylinder 22 on hydrophobic areas of the surface of the plate cylinder 20. The hydrophilic and hydrophobic areas on the surface of the plate cylinder are applied in advance according to chemical-physical processes. An offset plate serving as print carrier is usually secured on the generated surface of the plate cylinder 20. This offset plate is to be replaced for changing the print image.

Figure 2:
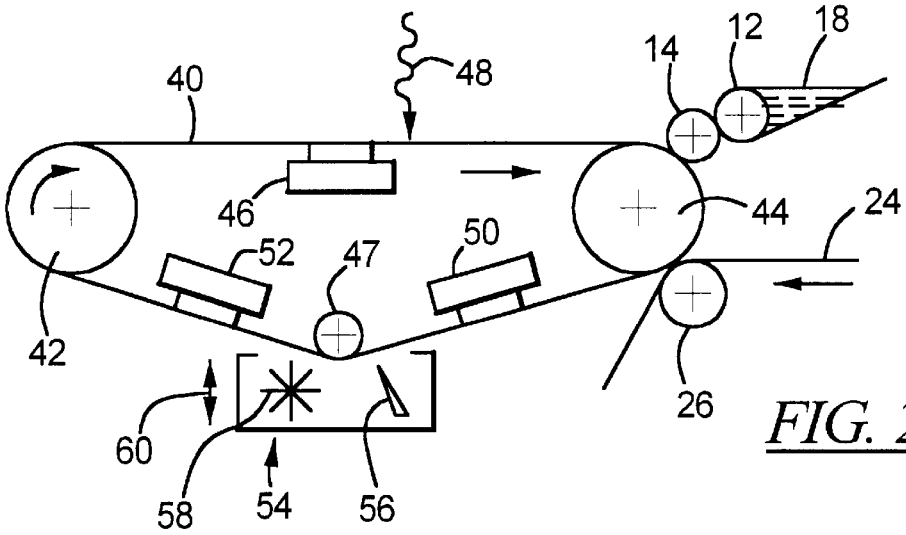
FIG. 2 is a side view showing an apparatus for printing, whereby areas with an ice layer are selectively produced on the print carrier.
Figure 3:
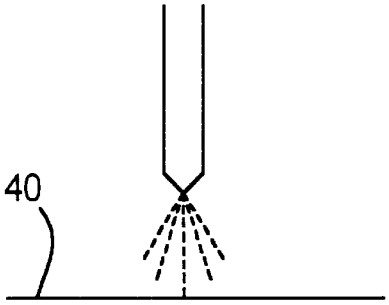
FIG. 3 is a schematic representation of a spraying apparatus for applying water or parting agent.
Figure 4:
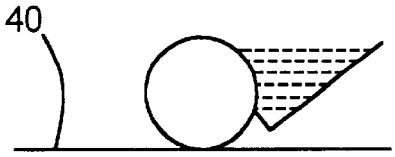
FIG. 4 is a schematic representation of a liquid applying roller for applying water or parting agent.

FIG. 2 schematically shows a printing means, whereby different print images can be produced on the same surface of the print carrier. The print carrier is a continuous belt 40 here that is conducted around a deflection roller 42, a transfer printing roller 44 and a cleaning roller 47. The surface of the continuous belt 40 is cooled with a cooling device 46 to a temperature below the solidification point of water. In a case of a normal environment with average atmospheric humidity, the temperature of the surface of the continuous belt 40 lies below 0° C. The water vapor contained in the ambient air precipitates on the continuous belt 40 as ice layer as a result of condensation. Due to the optional application of a tenside with the roller, a uniformly thin ice layer is assured. The tenside application roller can, for example, be provided close to the transfer printing roller 44 or at the deflection roller 42 in an arrangement similar to that for the elements 12, 14 and 18. Another possibility is comprised in applying a thin water film having a thickness in the $\mu$m range. An ice layer then arises by cooling. A spraying process as shown in FIG. 3 can be utilized for applying the water film or the application ensues with the assistance of rollers as shown in FIG. 4. The print-active surface of the continuous belt is thus completely provided with an ice layer. Subsequently, the ice layer is selectively removed by applying energy, for example by illumination with a laser beam 48, as indicated in FIG. 2. Alternatively to the ice layer, a parting agent layer of wax, fat, resin or fatty acid amide can also be employed, this being applied onto the print carrier in the liquid condition by being sprayed as shown in FIG. 3 or by being applied with one or more rollers as shown in FIG. 4. The medium will convert into its solid phase on the printing plate cooled below the solidification temperature of the respective substance.

The illumination preferably ensues raster-like line-by-line, whereby the water of the ice layer converts into the vapor state. Other methods for producing ice-free areas employ, for example, the radiation of a laser diode or of an LED. Given an arrangement of an LED array in line form, an energy application can ensue simultaneously over the entire width of the continuous belt 40, so that ice-free picture elements can be produced at high speed. It is also proposed that ice-free areas be produced upon employment of heating elements that are preferably arranged in a line.

The inking of the surface of the continuous belt 40 ensues with the assistance of the rollers 12 and 14 that transfer ink from the ink reservoir 18. The ink agglomerates to areas without an ice layer. As mentioned, the areas carrying an ice layer are ink-repellant and do not accept any ink.

The transfer printing roller 44 transfers the ink distributed on the continuous belt 40 onto a carrier material 24 supplied from the right in FIG. 2. The counter-pressure roller 26 presses the carrier material 24, generally paper, against the transfer printing roller 44.

Two operating modes are possible: in a first operating mode, the print image located on the continuous belt 40 is repeatedly inked and transfer-printed. For preserving the structured ice layer on the continuous belt 40, further cooling devices 50 and 52 are provided that keep the ice layer below its solidification temperature.

In a second operating mode, a new print image is applied onto the continuous belt 40. The previous structured ice layer is to be removed before this, as are the ink residues, and a defined initial condition is to be produced for the surface of the continuous belt 40. To this end, a cleaning means 54 is activated at the cleaning roller 47. It contains a wiper lip 56 and a brush 58 that are brought into contact with the surface of the continuous belt 40 and remove the structured ice layer. For activation and deactivation of the cleaning station 54, this can be moved in the direction of the arrow 60, such as by a motor. The additional cooling devices 50 and 52 are shut off in the second operating mode.

The cooling devices 46, 50, 52 can be constructed in the fashion of the cooling device in FIG. 1. Another possibility is comprised in the employment of an electro-thermal cooling principle, for example by employing Peltier elements. It should also be mentioned that the surface of the continuous belt 40 is composed of metals, for example of stainless steel, nickel, copper, chromium, or of plastics such as, for example, polyamide, PE, polytetrafluoroethylene, or as composed of metallized plastics that bond the ink well at the ice-free locations and thus promotes achieving a high printing quality.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for producing a print image on a carrier material, comprising the steps of:

defining ink-attracting and ink-repellant areas on a surface of a print carrier in conformity with a structure of the print image to be printed, said ink-repellant areas to be made ink repellant, providing the ink-repellant areas with a layer of an ink-repellant medium, supplying ink onto the surface, said ink adhering to the ink-attracting areas and being not picked up by the ink-repellant areas, printing the ink distributed on the surface onto the carrier material, using a substance in its solid phase as the ink-repellant medium in said ink-repellant areas, said substance being in a liquid state at room temperature, cooling the surface of the print carrier to produce the solid phase of the substance on the surface of the print carrier, said cooling resulting in cooling to below room temperature.

2. A method according to claim 1, wherein said cooling step cools the surface to a temperature below the solidification temperature of the substance for producing the solid-phase of the substance.

3. A method according to claim 1, further comprising the steps of:

initially completely covering the surface of the print carrier with a layer of the substance in the solid phase; and producing areas on the surface which are free of the substance in the solid phase in a structuring process as the ink-attracting areas in conformity with the structure of the print image to be printed.

4. A method according to claim 1, wherein said cooling step uses a coolant system for cooling the print carrier.

5. A method according to claim 1, wherein said cooling step includes electro-thermally cooling said surface.

6. A method as claimed in claim 5, wherein said electro-thermally cooling step uses Peltier elements.

7. A method according to claim 1, wherein said printing step includes directly transfer printing ink on the print carrier onto the carrier material.

8. A method according to claim 1, wherein said printing step includes initially transferring the ink onto an intermediate carrier and transfer printing from the intermediate carrier onto the carrier material.

9. A method according to claim 1, further comprising the step of: repeatedly inking ink attracting areas on the print carrier.

10. A method according to claim 1, wherein the surface of the print carrier is composed of metal.

11. A method according to claim 10, wherein the surface of the print carrier is composed of a material selected from the group consisting of stainless steel, chromium and nickel.

12. A method according to claim 1, wherein said step of providing the ink-repellant areas with the layer of the ink-repellant medium further includes:

producing a thin liquid film as the ink-repellant medium on the surface by spraying on the liquid.

13. A method according to claim 1, wherein the substance in the solid phase is a parting agent.

14. A method according to claim 13, wherein the parting agent is a material selected from the group consisting of wax, fat, resin and fatty acid amide.

15. A method as claimed in claim 1, wherein said step of providing the ink-repellant areas with the layer of the ink-repellant medium includes the substep of: producing a thin liquid film on the surface by rolling on the liquid.

16. A method as claimed in claim 1, wherein said step of providing the ink-repellant areas with the layer of the ink-repellant medium further includes:

producing a thin liquid film as the ink-repellant medium on the surface by rolling on the liquid.

17. An apparatus for producing a print image on a carrier material, comprising:

a print carrier having a surface defined with ink attracting areas and ink repelling areas in conformity with a structure of the print image to be printed, said ink repelling areas to be ink repelling, a layer of an ink-repellant medium on said ink repelling areas of the surface of the print carrier, said ink repellant medium being a substance in its solid phase, and a cooling mechanism mounted to cool the surface of the print carrier so that the solid phase of said substance is produced on the surface of the print carrier, said cooling mechanism cooling the surface to below room temperature to reach the solid phase of the substance.

18. An apparatus according to claim 17, wherein said cooling mechanism is operable to cool the surface of the print carrier to a temperature below the solidification temperature of the substance.

19. An apparatus according to claim 17, wherein said layer of said ink-repellant medium is structured with areas free of the substance in the solid phase as the ink-attracting areas in conformity with the structure of the print image to be printed.

20. An apparatus according to claim 17, wherein said cooling mechanism is an electro-thermally cooling mechanism.

21. An apparatus as claimed in claim 20, wherein said electro-thermically cooling mechanism includes Peltier elements.

22. An apparatus according to claim 17, further comprising:

a radiation emitter mounted to direct radiation toward said surface, the radiation emitter being selected from the group consisting of a laser, a laser diode, an LED and an LED array.

23. An apparatus according to claim 17, further comprising:

heating elements mounted to generate areas on said surface free of the solid phase of said substance.

24. An apparatus according to claim 17, further comprising:

a roller system mounted to ink the surface of the print carrier.

25. An apparatus according to claim 17, wherein the print carrier is mounted to directly transfer print onto the carrier material.

26. An apparatus according to claim 17, further comprising:

an intermediate carrier mounted between the print carrier and the carrier material.

* * * * *